US008457319B2

(12) United States Patent
Teo et al.

(10) Patent No.: US 8,457,319 B2
(45) Date of Patent: Jun. 4, 2013

(54) STEREO ENCODING DEVICE, STEREO DECODING DEVICE, AND STEREO ENCODING METHOD

(75) Inventors: Chun Woei Teo, Singapore (SG); Sua Hong Neo, Singapore (SG); Koji Yoshida, Kanagawa (JP); Michiyo Goto, Tokyo (JP)

(73) Assignee: Panasonic Corporation, Osaka (JP)

( * ) Notice: Subject to any disclaimer, the term of this patent is extended or adjusted under 35 U.S.C. 154(b) by 1169 days.

(21) Appl. No.: 12/064,995

(22) PCT Filed: Aug. 30, 2006

(86) PCT No.: PCT/JP2006/317104

§ 371 (c)(1),
(2), (4) Date: Feb. 27, 2008

(87) PCT Pub. No.: WO2007/026763

PCT Pub. Date: Mar. 8, 2007

(65) Prior Publication Data

US 2009/0262945 A1 Oct. 22, 2009

(30) Foreign Application Priority Data

Aug. 31, 2005 (JP) ..... 2005-252778

(51) Int. Cl.
*H04H 20/88* (2008.01)

(52) U.S. Cl.
USPC 381/2; 381/17; 381/18; 381/23; 704/E19.005

(58) Field of Classification Search
USPC ..... 381/17, 18, 23, 217; 704/E19.005
See application file for complete search history.

(56) References Cited

U.S. PATENT DOCUMENTS

| | | | | |
|---|---|---|---|---|
| 6,122,338 | A | 9/2000 | Yamauchi | |
| 6,487,528 | B1 * | 11/2002 | Vossing et al. | 704/229 |
| 6,529,604 | B1 | 3/2003 | Park et al. | |
| 2003/0236583 | A1 * | 12/2003 | Baumgarte et al. | 700/94 |
| 2004/0181395 | A1 * | 9/2004 | Kim et al. | 704/200.1 |

(Continued)

FOREIGN PATENT DOCUMENTS

| | | |
|---|---|---|
| JP | 10-105193 | 4/1998 |
| JP | 11-317672 | 11/1999 |

(Continued)

OTHER PUBLICATIONS

Search report from E.P.O., mail date is Feb. 22, 2011.

(Continued)

*Primary Examiner* — Lynne Gurley
*Assistant Examiner* — Vernon P Webb
(74) *Attorney, Agent, or Firm* — Greenblum & Berstein, P.L.C

(57) ABSTRACT

There is disclosed a stereo encoding device capable of accurately encoding a stereo signal at a low bit rate and suppressing delay in audio communication. The device performs monaural encoding in its first layer (110). In a second layer (120), a filtering unit (103) generates an LPC (Linear Predictive Coding) coefficient and generates a left channel drive sound source signal. A time region evaluation unit (104) and a frequency region evaluation unit (105) perform signal evaluation and prediction in both of their regions. A residual encoding unit (106) encodes a residual signal. A bit distribution control unit (107) adaptively distributes bits to the time region evaluation unit (104), the frequency region evaluation unit (105), and the residual encoding unit (106) according to a condition of the audio signal.

10 Claims, 5 Drawing Sheets

U.S. PATENT DOCUMENTS

| | | | |
|---|---|---|---|
| 2005/0078832 | A1 | 4/2005 | VanDe Par et al. |
| 2005/0091051 | A1 | 4/2005 | Moriya et al. |
| 2006/0147048 | A1 | 7/2006 | Breebaart et al. |
| 2007/0127729 | A1 | 6/2007 | Breebaart et al. |

FOREIGN PATENT DOCUMENTS

| | | |
|---|---|---|
| JP | 2004-289196 | 10/2004 |
| JP | 2004-302259 | 10/2004 |
| JP | 2005-517987 | 6/2005 |
| WO | 03/090208 | 10/2003 |
| WO | 2004/072956 | 8/2004 |

OTHER PUBLICATIONS

Goto et al., "Onse Tushinyo Scalable Stereo Onsei Fugoka Hoho no Kento," Dai 4 Kai Forum on Information Technology Koen Ronbunshu, Aug. 22, 2005, pp. 299-300.

Yoshida et al., "Scalable Stereo Onsei Fugoka no Channel-kan Yosoku ni Kansuru Yobi Kento," Proceedings of the 2005 IEICE General Conference, Mar. 7, 2005, p. 118.

Oshikiri et al., "Pitch Filtering ni Motozuku Spectrum Fugoka o Mochiita Cho Kotaiiki Scalable Onsei Fugoka no Kaizen," Journal of the Acoustical Society of Japan 2004 Nen Shuki Kenkyu Happyokai Koen Ronbunshu-I-, Sep. 21, 2004, pp. 297-298.

International Standard, ISO/IEC 1318-7, third edition, Oct. 15, 2004, Information technology—Generic coding of moving pictures and associated audio information—Part 7: Advanced Audio Coding (AAC), Reference No. ISO/IEC 1318-7:2004 (E), International Organization for Standardization.

U.S. Appl. No. 11/576,264 to Goto et al., filed Mar. 29, 2007.

U.S. Appl. No. 11/576,004 to Goto et al., filed Mar. 26, 2007.

U.S. Appl. No. 11/815,028 to Goto et al., filed Jul. 30, 2007.

U.S. Appl. No. 11/722,015 to Goto et al., filed Jun. 18, 2007.

U.S. Appl. No. 11/915,617 to Goto et al., filed Nov. 27, 2007.

KOREA Office action, mail date is Feb. 27, 2013.

* cited by examiner

STEREO ENCODING DEVICE, STEREO DECODING DEVICE, AND STEREO ENCODING METHOD

TECHNICAL FIELD

The present invention relates to a stereo coding apparatus, stereo decoding apparatus and stereo coding method that are used to encode/decode a stereo speech signal and stereo audio signal in mobile communication systems or packet communication systems using IP (Internet Protocol).

BACKGROUND ART

In mobile communication systems or packet communication systems using IP, the limitation of transmission bandwidth and the digital signal processing speed of DSP (Digital Signal Processor) is gradually becoming less important. If a transmission rate becomes a higher bit rate, bandwidth for transmitting a plurality of channels can be ensured, so that communication employing stereo schemes (stereo communication) is expected to be common even in speech communication where mono schemes are major streams.

A current mobile phone has already integrated a multimedia player and FM radio functionality which provide stereo capability. Therefore, it will be a natural extension to add stereo capability to the fourth generation mobile phones and IP telephones to record and playback not only stereo audio signals but also stereo speech signals.

There are many methods to encode stereo signals. Non-Patent Document 1 discloses a representative method called "MPEG-2 AAC" (Moving Picture Experts Group-2 Advanced Audio Coding). MPEG-2 AAC can encode signals in mono, stereo and multiple channels. MPEG-2 AAC performs MDCT (Modified Discrete Cosine Transform) processing to convert time domain signals into frequency domain signals. Further, MPEG-2 AAC exploits the human auditory system to generate good sound quality such that the coding artifacts are masked and kept below a human hearing threshold.

Non-Patent Document 1: ISO/IEC 13818-7:1997-MPEG-2 Advanced Audio Coding (AAC)

DISCLOSURE OF INVENTION

Problems to be Solved by the Invention

However, there is a problem that MPEG-2 AAC is more suitable for audio signals and not suitable for speech signals. By reducing the number of quantization bits for unimportant spectral information in communication of audio signals, MPEG-2 AAC realizes a stereo effect, good sound quality and low bit rate. However, the sound quality of speech signals deteriorates more significantly due to a lower bit rate than audio signals, and so, when MPEG-2 AAC which can provide excellent sound quality of audio signals is applied to speech signals, satisfiable sound quality may not be provided.

Another problem with MPEG-2 AAC is a delay due to the algorithm. A frame size used for MPEG-2 AAC is 1024 samples per frame. For example, if a sampling frequency is above 32 kHz, a frame delay is equal to or less than 32 milliseconds. This is still acceptable for real-time speech communication systems. However, MPEG-2 AAC requires MDCT processing which performs overlap-and-add (overlapped addition) of two adjacent frames in order to decode the encoded signal, and this algorithm always causes a processing delay, and so MPEG-2 AAC is not suitable for real-time communication systems.

In addition, coding can be performed using an AMR-WB (Adaptive Multi-Rate Wide Band) scheme for the lower bit rate, and this scheme only requires less than half bit rate compared to MPEG-2 AAC. However, there is a problem that only mono channel coding is supported in the AMR-WB scheme.

It is therefore an object of the present invention to provide a stereo coding apparatus, stereo decoding apparatus and stereo coding method that can encode a stereo signal accurately in a low bit rate and reduce a delay in speech communication.

Means for Solving the Problem

The stereo coding apparatus of the present invention employs a configuration having: a time domain estimating section that estimates a first channel signal of a stereo signal in a time domain and encodes the estimation result; and a frequency domain estimating section that partitions a frequency band of the first channel signal into a plurality of subbands, estimates the first channel signal in each subband in a frequency domain, and encodes the estimation result.

Advantageous Effect of the Invention

According to the present invention, it is possible to encode a stereo signal accurately in a low bit rate and reduce a delay in speech communication.

BEST MODE FOR CARRYING OUT THE INVENTION

An embodiment of the present invention will be described below in detail with reference to the accompanying drawings.

Figure 1:
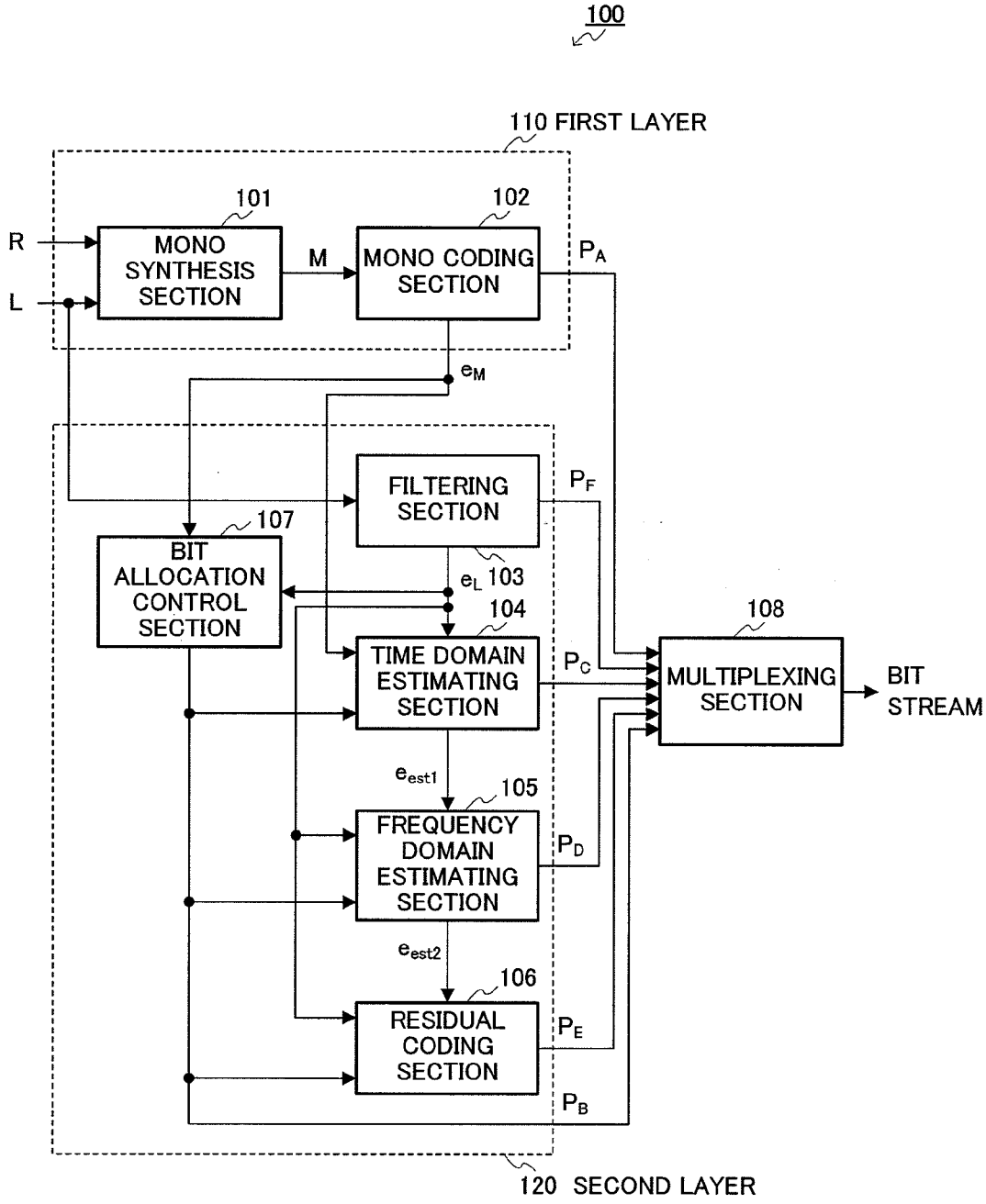
FIG. 1 is a block diagram showing main components of a stereo coding apparatus according to an embodiment of the present invention.

FIG. 1 is a block diagram showing the main components of stereo coding apparatus 100 of an embodiment of the present invention.

Stereo coding apparatus 100 employs a layered structure having first layer 110 and second layer 120 mainly.

In first layer 110, mono signal M is generated by using left channel signal L and right channel signal R which constitute stereo signals, and this mono signal is encoded to generate encoded information $P_A$ and mono excitation signal $e_M$. First layer 110 is configured with mono synthesis section 101 and mono coding section 102, and the processing of each section will be described below.

Mono synthesis section 101 synthesizes left channel signal L with right channel signal R and obtains mono signal M. Here, by calculating an average value of left channel signal L and right channel signal R, mono synthesis section 101 synthesizes mono signal M. This method is represented by M=(L+R)/2. In addition, other methods can also be used as the method of synthesizing a mono signal. One of the methods is represented by $M=w_1L+w_2R$ where $w_1$ and $w_2$ are weighting function such that $w_1+w_2=-1.0$.

Mono coding section 102 employs a configuration of a coding apparatus using the AMR-WB scheme. Mono coding section 102 encodes mono signal M outputted from mono synthesis section 101 using the AMR-WB scheme, and obtains encoded information $P_A$ to be outputted to multiplexing section 108. Further, mono coding section 102 outputs mono excitation signal $e_M$ obtained in the coding process to second layer 120.

In second layer 120, prediction and estimation in the time domain and frequency domain are performed on the stereo speech signal, and various encoded information is generated. In this processing, first, spatial information of left channel signal L, which forms the stereo speech signal, is detected and calculated. By this spatial information, the stereo speech signal provides sensation of presence (stereo image). Next, an estimated signal similar to left channel signal L is generated by providing this spatial information to the mono signal, and the information of each processing is outputted as encoded information. Second layer 120 is configured with filtering section 103, time domain estimating section 104, frequency domain estimating section 105, residual coding section 106 and bit allocation control section 107. The operations of each section will be described below.

Filtering section 103 generates the LPC (Linear Predictive Coding) coefficients by LPC-analysis for left channel signal L and outputs these LPC coefficients to multiplexing section 108 as encoded information $P_F$. Further, filtering section 103 generates left channel excitation signal $e_L$ using left channel signal L and the LPC coefficients, and outputs this excitation signal $e_L$ to time domain estimating section 104.

Time domain estimating section 104 performs estimation and prediction in the time domain on mono excitation signal $e_M$ generated in mono coding section 102 of first layer 110 and left channel excitation signal $e_L$ generated in filtering section 103, generates time domain estimated signal $e_{est1}$ and outputs time domain estimated signal $e_{est1}$ to frequency domain estimating section 105. That is, time domain estimating section 104 detects and calculates the spatial information in the time domain between mono excitation signal $e_M$ and left channel excitation signal $e_L$.

Frequency domain estimating section 105 performs estimation and prediction in the frequency domain on left channel excitation signal $e_L$ generated in filtering section 103 and time domain estimated signal $e_{est1}$ generated in time domain estimating section 104, generates frequency domain estimated signal $e_{est2}$ and outputs frequency domain estimated signal $e_{est2}$ to residual coding section 106. That is, frequency domain estimating section 105 detects and calculates the spatial information in the frequency domain between time domain estimated signal $e_{est1}$ and left channel excitation signal $e_L$.

Residual coding section 106 estimates the residual signal between frequency domain estimated signal $e_{est2}$ generated in frequency domain estimating section 105 and left channel excitation signal $e_L$ generated in filtering section 103, encodes this signal, generates encoded information $P_E$ and outputs this encoded information $P_E$ to multiplexing section 108.

Bit allocation control section 107 allocates encoded bits to time domain estimating section 104, frequency domain estimating section 105 and residual coding section 106 according to the degree of similarities between mono excitation signal $e_M$ generated in mono coding section 102 and left channel excitation signal $e_L$ generated in filtering section 103. Further, bit allocation control section 107 encodes information related to the number of bits allocated to each section and outputs obtained encoded information $P_B$.

Multiplexing section 108 multiplexes encoded information $P_A$ to $P_F$ and outputs the multiplexed bit streams.

The stereo decoding apparatus corresponding to stereo coding apparatus 100 can obtain encoded information $P_A$ of the mono signal generated in first layer 110 and encoded information $P_B$ to $P_F$ of the left channel signal generated in second layer 120 and decode the mono signal and left channel signal by these encoded information. Further, the stereo decoding apparatus can generate a right channel signal from the decoded mono signal and decoded left channel signal.

Figure 2:
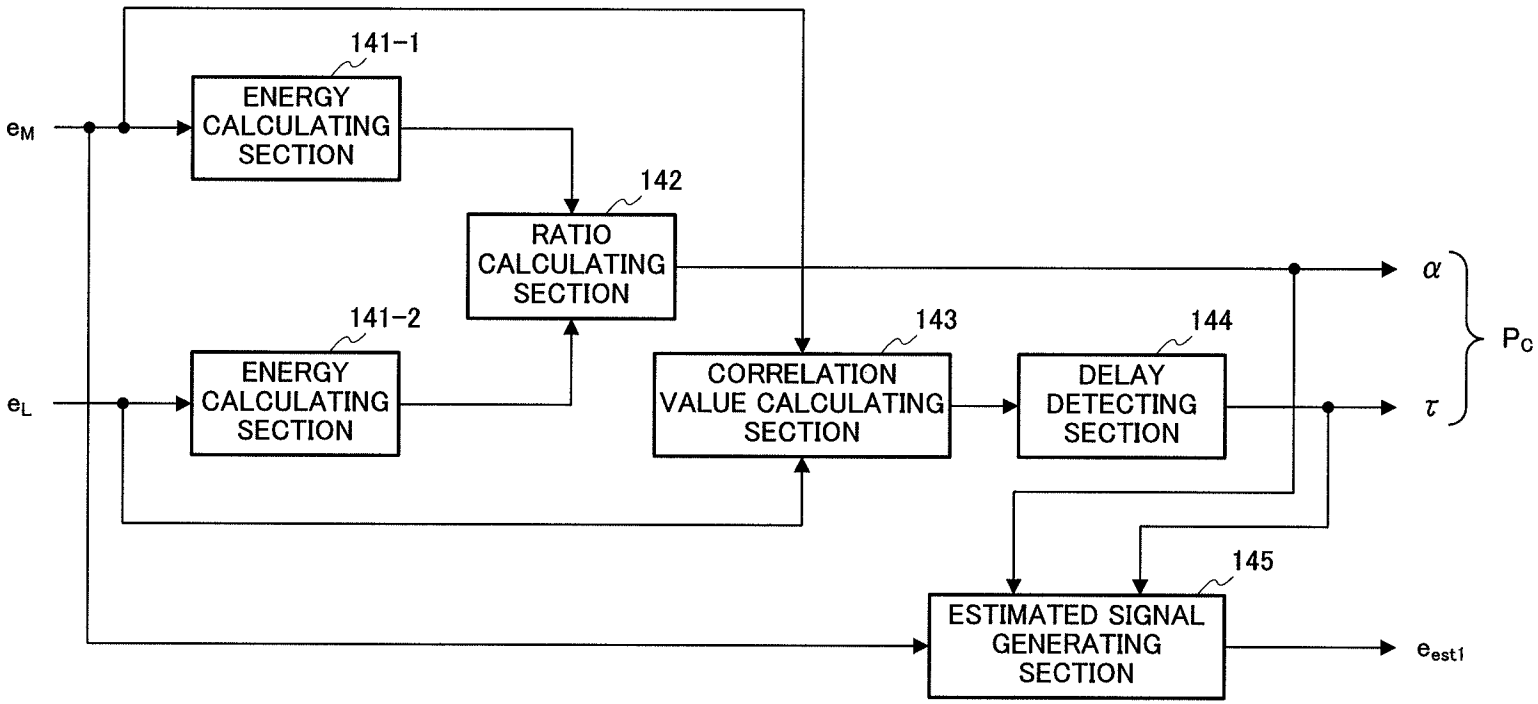
FIG. 2 is a block diagram showing main components of a time domain estimating section according to an embodiment of the present invention.

FIG. 2 is a block diagram showing the main components of time domain estimating section 104. Mono excitation signal $e_M$ and left channel excitation signal $e_L$ are inputted to time domain estimating section 104 as a target signal and reference signal, respectively. Time domain estimating section 104 detects and calculates the spatial information between mono excitation signal $e_M$ and left channel excitation signal $e_L$ once per frame of speech signal processing, encodes the detected and calculated results into encoded information $P_C$ and outputs this encoded information $P_C$. Here, the spatial information in the time domain is comprised of amplitude information $\alpha$ and delay information $\tau$.

Energy calculating section 141-1 receives mono excitation signal $e_M$ and calculates the energy of this signal in the time domain.

Energy calculating section 141-2 receives left channel excitation signal $e_L$, and calculates the energy of this signal in the time domain by processing similar to energy calculating section 141-1.

Ratio calculating section 142 receives values of the energy calculated in energy calculating sections 141-1 and 141-2, calculates an energy ratio between mono excitation signal $e_M$ and left channel excitation signal $e_L$, and outputs the calculated energy ratio as the spatial information between mono excitation signal $e_M$ and left channel excitation signal $e_L$ (amplitude information $\alpha$).

Correlation value calculating section 143 receives mono excitation signal $e_M$ and left channel excitation signal $e_L$ and calculates a cross correlation value between these two signals.

Delay detecting section 144 receives the cross correlation value calculated in correlation value calculating section 143, detects a time delay between left channel excitation signal $e_L$ and mono excitation signal $e_M$, and outputs the detected time delay as the spatial information (delay information $\tau$) between mono excitation signal $e_M$ and left channel excitation signal $e_L$.

Estimated signal generating section 145 generates time domain estimated signal $e_{est1}$ similar to left channel excitation signal $e_L$ from mono excitation signal $e_M$, according to amplitude information $\alpha$ calculated in ratio calculating section 142 and delay information $\tau$ calculated in delay detecting section 144.

As described above, time domain estimating section 104 detects and calculates the spatial information in the time domain between mono excitation signal $e_M$ and left channel excitation signal $e_L$ once per frame of speech signal processing, and outputs obtained encoded information $P_C$. Here, the spatial information is comprised of amplitude information $\alpha$ and delay information $\tau$. Further, time domain estimating section 104 provides this spatial information to mono excitation signal $e_M$ and generates time domain estimated signal $e_{est1}$ similar to left channel excitation signal $e_L$.

Figure 3:
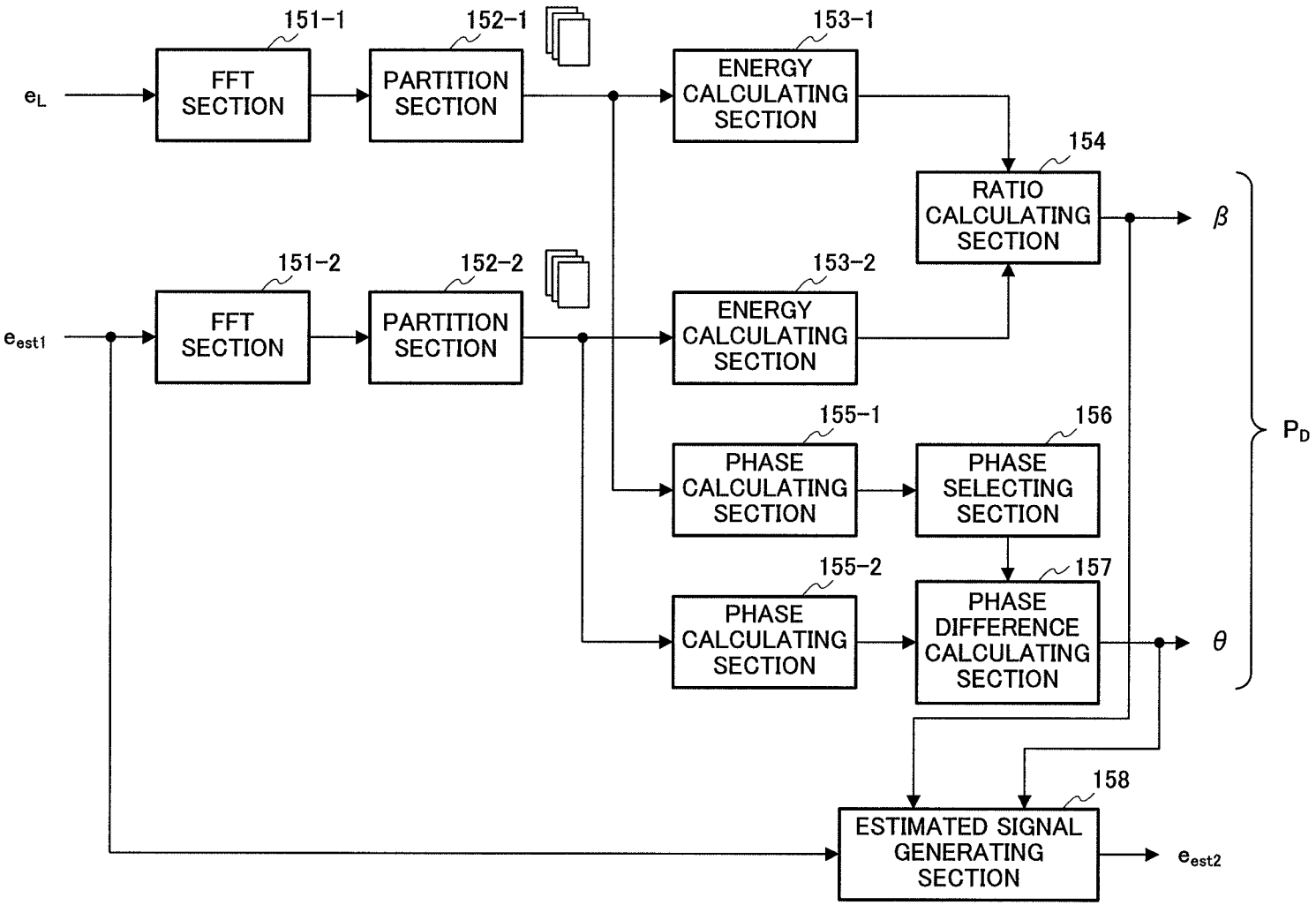
FIG. 3 is a block diagram showing main components of a frequency domain estimating section according to an embodiment of the present invention.

FIG. 3 is a block diagram showing the main components of frequency domain estimating section 105. Frequency domain estimating section 105 inputs time domain estimated signal $e_{est1}$ generated in time domain estimating section 104 as a target signal and left channel excitation signal $e_L$ as a reference signal, performs estimation and prediction in the frequency domain, encodes the results of estimation and prediction and outputs these encoded results as encoded information $P_D$. Here, the spatial information in the frequency domain is comprised of spectral amplitude information $\beta$ and phase difference information $\theta$.

FFT section 151-1 converts left channel excitation signal $e_L$, which is the time domain signal, into the frequency domain signal (spectrum) by FFT (Fast Fourier Transform).

Partition section 152-1 partitions a band of the frequency domain signal generated in FFT section 151-1 into a plurality of bands (subbands). Each subband may follow a bark scale according to the human hearing system and may be divided equally within the bandwidth.

Energy calculating section 153-1 calculates a spectral energy of left channel excitation signal $e_L$ per subband outputted from partition section 152-1.

FFT section 151-2 converts time domain estimated signal $e_{est1}$ into a frequency domain signal by processing similar to FFT section 151-1.

Partition section 152-2 partitions a band of the frequency domain signal generated in FFT section 151-2 into a plurality of subbands by processing similar to partition section 152-1.

Energy calculating section 153-2 calculates a spectral energy of time domain estimated signal $e_{est1}$ per subband outputted from partition section 152-2 by processing similar to energy calculating section 153-1.

Ratio calculating section 154 calculates a spectral energy ratio per subband between left channel excitation signal $e_L$ and time domain estimated signal $e_{est1}$ using the spectral energy per subband calculated in energy calculating sections 153-1 and 153-2, and outputs the calculated spectral energy ratio as amplitude information $\beta$, which is part of encoded information $P_D$.

Phase calculating section 155-1 calculates a spectral phase in each subband of left channel excitation signal $e_L$.

Phase selecting section 156 selects one phase suitable for coding, from the spectral phase in each subband to reduce the amount of encoded information.

Phase calculating section 155-2 calculates a spectral phase in each subband of time domain estimated signal $e_{est1}$ by processing similar to phase calculating section 155-1.

Phase difference calculating section 157 calculates a phase difference between left channel excitation signal $e_L$ and time domain estimated signal $e_{est1}$ in the phase selected in phase selecting section 156 in each subband, and outputs the calculated phase difference as phase difference information $\theta$ which is part of encoded information $P_D$.

Estimated signal generating section 158 generates frequency domain estimated signal $e_{est2}$ from time domain estimated signal $e_{est1}$ based on both amplitude information $\beta$ between left channel excitation signal $e_L$ and time domain estimated signal $e_{est1}$, and phase difference information $\theta$ between left channel excitation signal $e_L$ and time domain estimated signal $e_{est1}$.

As described above, frequency domain estimation section 105 partitions left channel excitation signal $e_L$ and time domain estimated signal $e_{est1}$ generated in time domain estimating section 104 into a plurality of subbands, respectively, and calculates a spectral energy ratio and phase difference per subband between time domain estimated signal $e_{est1}$ and left channel excitation signal $e_L$. The time delay in the time domain is equivalent to the phase difference in the frequency domain. Therefore, by calculating a phase difference in the frequency domain and controlling or adjusting the calculated phase difference accurately, it is possible to encode characteristics, which cannot be encoded enough in the time domain, in the frequency domain and improve coding accuracy.

Frequency domain estimating section 105 gives the detailed difference calculated by the frequency domain estimation to time domain estimated signal $e_{est1}$ which is similar to left channel excitation signal $e_L$ obtained by the time domain estimation, and generates frequency domain estimated signal $e_{est2}$ which is more similar to left channel excitation signal $e_L$. Further, frequency domain estimating section 105 gives this spatial information to time domain estimated signal $e_{est1}$ and generates frequency domain estimated signal $e_{est2}$ which is more similar to left channel excitation signal $e_L$.

Next, the operations of bit allocation control section 107 will be explained below in detail. The number of bits for coding allocated to each frame of the speech signal is determined in advance. For realizing optimum sound quality at this predetermined bit rate, bit allocation control section 107 adaptively determines the number of bits allocated to each processing section, depending on whether or not left channel excitation signal $e_L$ is similar to mono excitation signal $e_M$.

Figure 4:
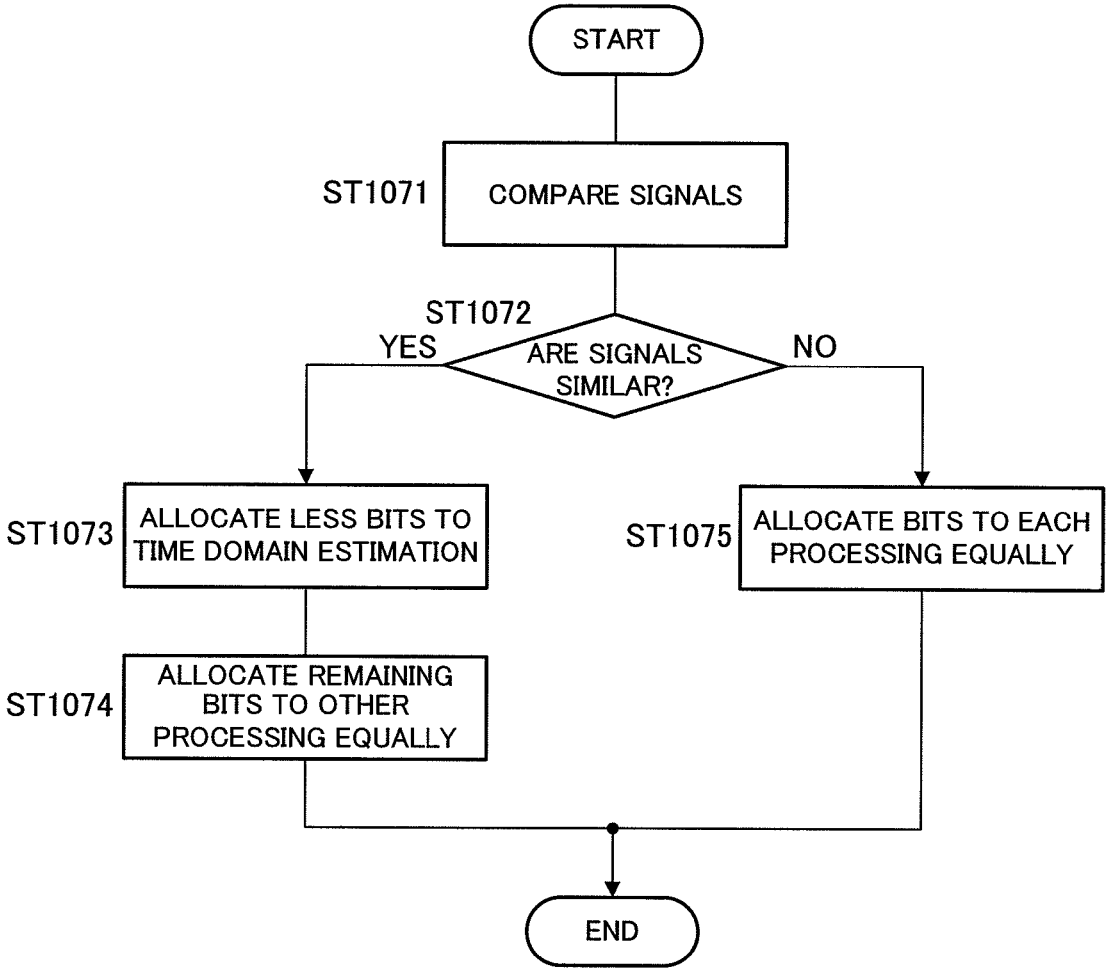
FIG. 4 is a flowchart showing an operation of a bit allocation control section according to an embodiment of the present invention.

FIG. 4 is a flowchart showing the operations of bit allocation control section 107.

In ST (step) 1071, bit allocation control section 107 compares mono excitation signal $e_M$ to left channel excitation signal $e_L$ and determines the degree of similarities between these two signals in the time domain. In particular, bit allocation control section 107 calculates a root mean square error between mono excitation signal $e_M$ and left channel excitation signal $e_L$, compares the root mean square error to a specified threshold, and determines that these two signals are similar signals if the calculated root mean square error is equal to or less than the threshold.

When mono excitation signal $e_M$ is similar to left channel excitation signal $e_L$ ("Yes" in ST1072), a difference between these two signals in the time domain is small, and the smaller number of bits may be needed to encode the smaller difference. That is, when bits are allocated unevenly such that fewer bits are allocated to time domain estimating section 104 compared to other sections (such as frequency domain estimating section 105 and residual coding section 106), particularly to frequency domain estimating section 105, efficient bit allocation is realized, so that it is possible to improve coding efficiency. Therefore, when bit allocation control section 107 determines that mono excitation signal $e_M$ is similar to left channel excitation signal $e_L$ in ST1072, bit allocation control section 107 allocates fewer bits to the time domain estimation in ST1073 and allocates the remaining bits to the other processing equally in ST1074.

By contrast, when mono excitation signal $e_M$ and left channel excitation signal $e_L$ are dissimilar ("No" in ST1072), a difference between two time domain signals becomes larger. In this case, the time domain estimation may only be able to estimate the signal to a certain degree of similarities. Therefore, signal estimation in the frequency domain is important to improve accuracy of the estimated signal. That is, both the time domain estimation and the frequency domain estimation are equally important. Further, in this case, after the frequency domain estimation, there may still be some difference between the estimated signal and left channel excitation signal $e_L$, and so it is important to encode the residual signal and obtain encoded information. Therefore, when bit allocation control section 107 determines that mono excitation signal $e_M$ and left channel excitation signal $e_L$ are dissimilar in ST1072, bit allocation control section 107 determines that all processing is equally important and allocates bits to all processing equally in ST1075.

Figure 5:
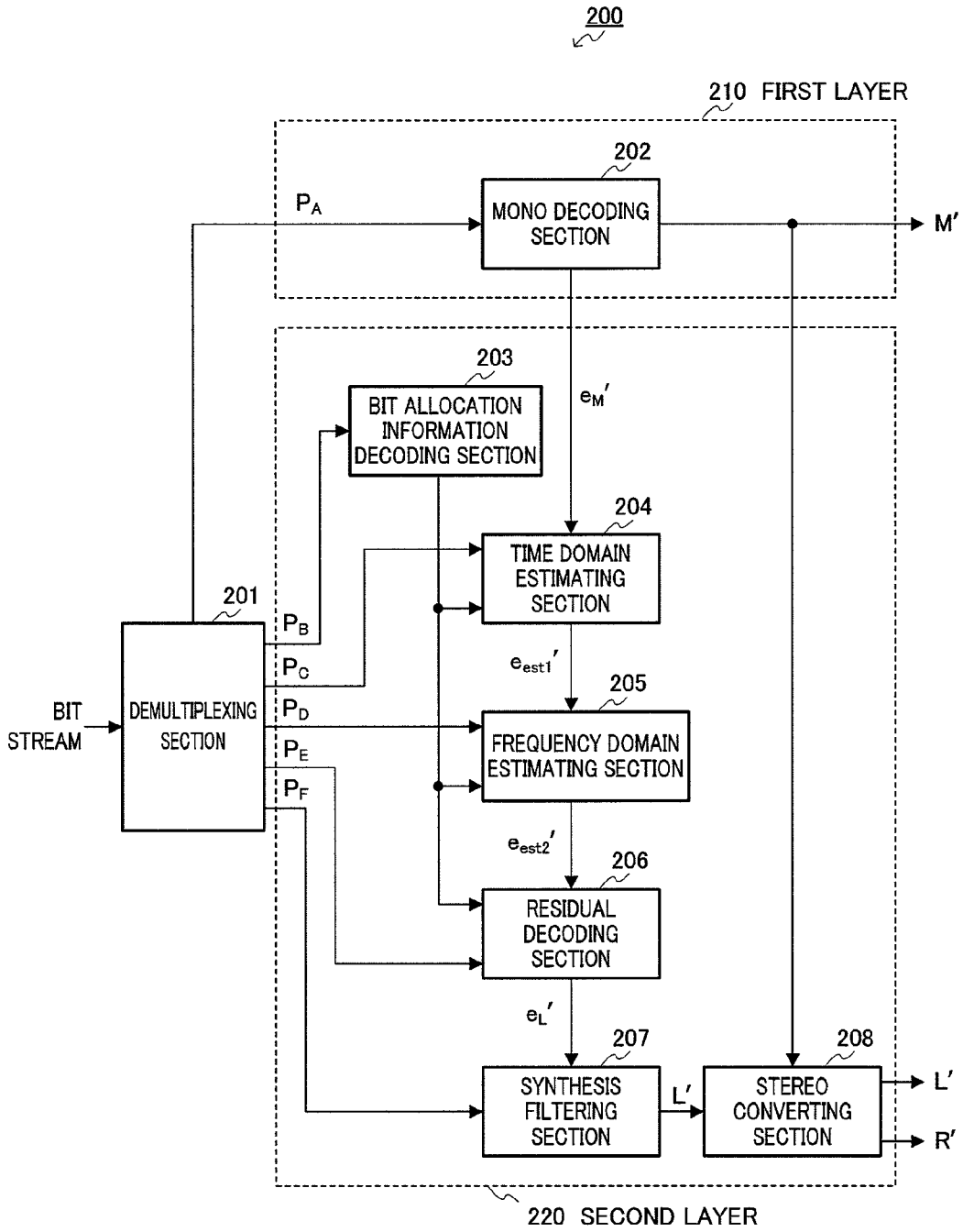
FIG. 5 is a block diagram showing main components of a stereo decoding apparatus according to an embodiment of the present invention.

FIG. 5 is a block diagram showing the main components of stereo decoding apparatus 200 according to the present embodiment.

Stereo decoding apparatus 200 also employs a layered structure having first layer 210 and second layer 220 mainly. Further, each processing of stereo decoding apparatus 200 is basically reverse processing of the corresponding processing of stereo coding apparatus 100. That is, stereo decoding apparatus 200 performs prediction and generates a left channel signal from a mono signal using the encoded information transmitted from stereo coding apparatus 100, and further generates a right channel signal using the mono signal and the left channel signal.

Demultiplexing section 201 demultiplexes the inputted bit stream into encoded information $P_A$ to $P_F$.

First layer 210 is configured with mono decoding section 202. Mono decoding section 202 decodes encoded information $P_A$ and generates mono signal M' and mono excitation signal $e_M'$.

Second layer 220 is configured with bit allocation information decoding section 203, time domain estimating section 204, frequency domain estimating section 205 and residual decoding section 206, and the sections perform the following operations.

Bit allocation information decoding section 203 decodes encoded information $P_B$ and outputs the number of bits used in time domain estimating section 204, frequency domain estimating section 205 and residual decoding section 206, respectively.

Time domain estimating section 204 performs estimation and prediction in the time domain using mono excitation signal $e_M'$ generated in mono decoding section 202, encoded information $P_C$ outputted from demultiplexing section 201, and the number of bits outputted from bit allocation information decoding section 203, and generates time domain estimated signal $e_{est1}'$.

Frequency domain estimating section 205 performs estimation and prediction using time domain estimated signal $e_{est1}'$ generated in time domain estimating section 204, encoded information $P_D$ outputted from demultiplexing section 201 and the number of bits transmitted from bit allocation information decoding section 203, and generates frequency domain estimated signal $e_{est2}'$. Frequency domain estimating section 205 has FFT section that performs frequency conversion before the estimation and prediction in the frequency domain, as with frequency domain estimating section 105 of stereo coding apparatus 100.

Residual decoding section 206 decodes a residual signal using encoded information $P_E$ outputted from demultiplexing section 201 and the number of bits transmitted from bit allocation information decoding section 203. Further, residual decoding section 206 gives this decoded residual signal to frequency domain estimated signal $e_{est2}'$ generated in frequency domain estimating section 205, and generates left channel excitation signal $e_L'$.

Synthesis filtering section 207 decodes the LPC coefficients from encoded information $P_F$, perform a synthesis using this encoded LPC coefficients and left channel excitation signal $e_L$ generated in residual decoding section 206, and generates left channel signal L'.

Stereo converting section 208 generates right channel signal R' using mono signal M' decoded in mono decoding section 202 and left channel signal L' generated in synthesis filtering section 207.

As described above, the stereo coding apparatus according to the present embodiment first performs estimation and prediction in the time domain and performs more detailed estimation and prediction in the frequency domain on a stereo speech signal which is a target signal for coding, and outputs information resulted from this two-stage estimation and prediction as encoded information. Therefore, complementary estimation and prediction in the frequency domain can be performed on information that cannot be estimated adequately by the estimation and prediction in the time domain, so that it is possible to encode the stereo speech signal in a low bit rate accurately.

Further, according to the present embodiment, the time domain estimation in time domain estimating section 104 corresponds to estimation of an average level of spatial information of signals over the whole frequency band. For example, the energy ratio and time delay estimated as spatial information in time domain estimating section 104 corresponds to an overall or average energy ratio and time delay of this signal estimated by processing the target signal for coding of one frame as is as whole signal. On the other hand, the frequency domain estimation in frequency domain estimating section 105 partitions the frequency band of the target signal for coding into a plurality of subbands and estimates individual partitioned signals. In other words, according to the present embodiment, the rough estimation is performed on the stereo speech signal in the time domain, and the estimated signal is fine tuned by further performing estimation in the frequency domain. Therefore, with respect to information that cannot be estimated adequately when the target signal for coding is processed as whole signal, the target signal is partitioned into a plurality of signals, and further estimation is performed on individual partitioned signals, so that it is possible to improve coding accuracy of the stereo speech signal.

Further, according to the present embodiment, bits are adaptively allocated to each processing such as time domain estimation and frequency domain estimation within a predetermined bit rate according to the degree of similarities between the mono signal and the left channel signal (or right channel signal), that is, according to the characteristic of the stereo speech signal. By this means, it is possible to perform coding efficiently and accurately, and realize bit rate scalability.

Further, according to the present embodiment, MDCT processing required for MPEG-2 AAC is not needed, so that it is possible to keep the time delay within the limit of allowable range in communication systems such as real-time speech communication systems.

Further, according to the present embodiment, coding is performed using a few parameters, which are the energy ratio and the time delay, so that it is possible to reduce a bit rate.

Further, according to the present embodiment, a layered structure having two layers is employed, so that it is possible to scale from a mono level to a stereo level. By this means, when information related to the frequency domain estimation cannot be decoded for some reasons, by decoding only information related to the time domain estimation, although quality of the stereo speech signal deteriorates a little, the stereo speech signal with predetermined quality can be decoded, so that it is possible to improve scalability.

Further, according to the present embodiment, the mono signal is encoded in the AMW-WB scheme in the first layer, so that it is possible to maintain a low bit rate.

Further, the stereo coding apparatus, stereo decoding apparatus and stereo coding method of the present embodiment can be implemented by making various modifications.

For example, although a case has been described with the present embodiment where the mono signal and left channel signal are target signals for coding in stereo coding apparatus 100 and the right channel signal is decoded by decoding the mono signal and left channel signal and synthesizing these signals in stereo decoding apparatus 200, target signals for coding in stereo coding apparatus 100 are not limited thereto, and the mono signal and the right channel signal may be target signals for coding in stereo coding apparatus 200, and the left channel signal may be generated by synthesizing the right channel signal with the mono signal decoded in stereo decoding apparatus 200.

Further, in filtering section 103 of the present embodiment, the other equivalent parameters (for example, LSP parameter) converted from LPC coefficients may be used as encoded information for the LPC coefficients.

Further, although a case has been described with the present embodiment where a predetermined number of bits are allocated to each processing in bit allocation control section 107, bit allocation control processing may not be performed, and fixed bit allocation may be performed such that the number of bits allocated to each section is determined in advance. In this case, bit allocation control section 107 is not needed in stereo coding apparatus 100. In addition, the ratio of this fixed bit allocation is common in stereo coding apparatus 100 and stereo decoding apparatus 200, and bit allocation information decoding section 203 is not needed in stereo decoding apparatus 200.

Further, although a case has been described with the present embodiment where bit allocation control section 107 performs bit allocation adaptively according to the characteristic of the stereo speech signal, bit allocation control section 107 may perform bit allocation adaptively according to the condition of the network.

Further, residual coding section 106 of the present embodiment serves as a lossy system by performing coding using the predetermined number of bits allocated by bit allocation control section 107. As an example of coding using the predetermined number of bits, there is vector quantization. Generally, a residual coding section serves as one of a lossy system and a lossless system which have different features, according to the coding method. Although features of the lossless system include decoding a signal by a decoding apparatus more accurately than the lossy system, a compression ratio in the lossless system is low, and so the bit rate becomes high. For example, if a residual signal is encoded by a noiseless coding method such as Huffman coding and Rice coding, residual coding section 106 serves as a lossless system.

Further, although a case has been described with the present embodiment where ratio calculating section 142 calculates as amplitude information $\alpha$ an energy ratio between mono excitation signal $e_M$ and left channel excitation signal $e_L$, ratio calculating section 142 may calculate as amplitude information $\alpha$ an energy difference instead of the energy ratio.

Further, although a case has been described with the present embodiment where ratio calculating section 154 calculates as amplitude information $\beta$ spectral energy ratio $\beta$ between left channel excitation signal $e_L$ and time domain estimated signal $e_{est1}$, ratio calculating section 154 may calculate as amplitude information $\beta$ an energy difference instead of the energy ratio.

Further, although a case has been described with the present embodiment where the spatial information in the time domain between mono excitation signal $e_M$ and left channel excitation signal $e_L$ is comprised of amplitude information $\alpha$ and delay information $\tau$, this spatial information may further include other information or may be comprised of other information which is completely different from amplitude information $\alpha$ and delay information $\tau$.

Further, although a case has been described with the present embodiment where the spatial information is comprised of amplitude information $\beta$ and phase difference information $\theta$ in the frequency domain between left channel excitation signal $e_L$ and time domain estimated signal $e_{est1}$, this spatial information may further include other information or may be comprised of other information which is completely different from amplitude information $\beta$ and phase difference information $\theta$.

Further, although a case has been described with the present embodiment where time domain estimating section 104 detects and calculates the spatial information between mono excitation signal $e_M$ and left channel excitation signal $e_L$ per frame, this processing may be performed a plurality of times in one frame.

Further, although a case has been described with the present embodiment where phase selecting section 156 selects one spectral phase in each subband, phase selecting section 156 may select a plurality of spectral phases. In this case, phase difference calculating section 157 calculates an average of phase differences $\theta$ between left channel excitation signal $e_L$ and time domain estimated signal $e_{est1}$, and outputs the average value to phase difference calculating section 157.

Further, although a case has been described with the present embodiment where residual coding section 106 performs time domain coding on a residual signal, residual coding section 106 may perform frequency domain coding.

Further, although a case has been described with the present embodiment where a speech signal is a target signal for coding, the stereo coding apparatus, stereo decoding apparatus and stereo coding method according to the present invention are applicable to other audio signals in addition to speech signals.

The embodiment of the present invention has been described above.

The stereo coding apparatus and stereo decoding apparatus according to the present invention can be provided to communication terminal apparatuses and base station apparatuses of mobile communication systems. By this means, it is possible to provide a communication terminal apparatus, base station apparatus and mobile communication system which have the same effect as described above.

In the above embodiments, although a case has been described as an example where the present invention is implemented with hardware, the present invention can be implemented with software. For example, by describing the stereo coding method and stereo decoding method algorithm according to the present invention in a programming language, storing this program in a memory and making the information processing section execute this program, it is possible to implement the same function as the stereo coding apparatus and stereo decoding apparatus of the present invention.

Furthermore, each function block employed in the description of each of the aforementioned embodiments may typically be implemented as an LSI constituted by an integrated circuit. These may be individual chips or partially or totally contained on a single chip.

"LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells in an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The present application is based on Japanese Patent Application No. 2005-252778, filed on Aug. 31, 2005, the entire content of which is expressly incorporated by reference herein.

INDUSTRIAL APPLICABILITY

The stereo coding apparatus, stereo decoding apparatus and stereo coding method of the present invention are suitable for use in mobile phones, IP telephones, television conference, and the like.

The invention claimed is:

1. A stereo coding apparatus, comprising:

a time domain estimator that estimates a first channel signal of a stereo signal in a time domain and encodes the estimation result; and a frequency domain estimator that partitions a frequency band of the first channel signal into a plurality of subbands, estimates the first channel signal in each subband in a frequency domain, and encodes the estimation result, wherein bits are allocated for time domain estimation and frequency domain estimation according to a degree of similarity calculated in the time domain between the first channel signal and an encoded mono signal generated from the stereo signal.

2. The stereo coding apparatus according to claim 1, further comprising:

a first layer coder that encodes the mono signal generated from the stereo signal; and a second layer coder that comprises the time domain estimator and the frequency domain estimator.

3. The stereo coding apparatus according to claim 2, wherein:

the time domain estimator performs time domain estimation using the mono signal and generates a time domain estimated signal similar to the first channel signal; and the frequency domain estimator partitions a frequency band of the time domain estimated signal into a plurality of subbands in the same way as the first channel signal, performs frequency domain estimation using the time domain estimated signal in each subband and generates a frequency domain estimated signal similar to the first channel signal.

4. The stereo coding apparatus according to claim 2, further comprising a bit allocator that allocates the bits to the time domain estimator and the frequency domain estimator.

5. The stereo coding apparatus according to claim 4, wherein, when the degree of similarity between the first channel signal and the mono signal is equal to or greater than a predetermined threshold, the bit allocator allocates more bits to the frequency domain estimator.

6. The stereo coding apparatus according to claim 4, wherein, when the degree of similarities between the first channel signal and the mono signal is less than the predetermined threshold, the bit allocator allocates bits to the time domain estimator and the frequency domain estimator equally.

7. The stereo coding apparatus according to claim 3, further comprising a residual coder that encodes a residual signal between the first channel signal and the frequency domain estimated signal.

8. The stereo coding apparatus according to claim 3, wherein:

the time domain estimator calculates spatial information between the first channel signal and the mono signal in the time domain estimation; and the frequency domain estimator calculates spatial information between the first channel signal and the time domain estimated signal in the frequency domain estimation.

9. A stereo decoding apparatus, comprising:

a time domain decoder that decodes encoded information that is an encoded result of time domain estimation of a first channel signal of a stereo signal; and a frequency domain decoding apparatus that decodes encoded information that is an encoded result of frequency domain estimation of the first channel signal in a plurality of subbands partitioned from a frequency band of the first channel signal, wherein bits are allocated for time domain estimation and frequency domain estimation according to a degree of similarity calculated in the time domain between the first channel signal and an encoded mono signal generated from the stereo signal.

10. A stereo coding method, comprising:

estimating a first channel signal of a stereo signal in a time domain;

encoding the estimation result in the time domain;

partitioning a frequency band of the first channel signal into a plurality of subbands;

estimating the first channel signal in each partitioned subband in a frequency domain;

encoding the estimation result in the frequency domain; and allocating bits for time domain estimation and frequency domain estimation according to a degree of similarity calculated in the time domain between the first channel signal and an encoded mono signal generated from the stereo signal.

* * * * *